United States Patent [19]

Slowinski et al.

[11] 4,211,274

[45] Jul. 8, 1980

[54] EQUIPMENT FOR COOLING AND SEPARATION OF CASTINGS AND MOULDING SAND

[75] Inventors: Stanislaw Slowinski; Stanislaw Vasina; Jerzy Pasich; Jerzy Kosek; Stanislaw Glownia, all of Cracow, Poland

[73] Assignee: Przedsiegiorstwo Projektowania I Wyposazania Odlewni "Prodlew", Warsaw, Poland

[21] Appl. No.: 905,179

[22] Filed: May 10, 1978

[30] Foreign Application Priority Data

May 12, 1977 [PL] Poland ..... 198090
Jun. 13, 1977 [PL] Poland ..... 198820

[51] Int. Cl.[2] ..... B22D 29/00

[52] U.S. Cl. ..... 164/401; 51/164.1; 209/238

[58] Field of Search ..... 164/344, 345, 404, 131, 164/132, 401, 5, 412; 51/164 R; 34/13, 127, 128, 130; 209/11, 238; 425/222

[56] References Cited

U.S. PATENT DOCUMENTS

| | | | |
|---|---|---|---|
| Re. 29,709 | 7/1978 | Vissers | 51/164 R X |
| 1,312,173 | 8/1919 | Gerlach et al. | 209/11 X |
| 1,768,570 | 7/1930 | Clark | 51/164 R X |
| 2,955,305 | 10/1960 | Jooss et al. | 51/164 R X |
| 3,469,324 | 9/1969 | Vissers | 34/13 |
| 3,871,438 | 3/1975 | Vissers et al. | 164/5 |
| 3,998,262 | 12/1976 | Didion | 164/131 |
| 4,113,413 | 9/1978 | Pietrusza et al. | 425/222 |

*Primary Examiner*—Robert D. Baldwin
*Assistant Examiner*—J. Reed Batten, Jr.
*Attorney, Agent, or Firm*—Haseltine, Lake & Waters

[57] ABSTRACT

An apparatus for separating castings from moulding sand is provided with a container revolving around the longitudinal horizontal or near horizontal axis. The side surface of the container is provided with suitable slots ensuring an inflow of air into this container. The slots are located at one or several points before a sieve wall located at the end of the container. The sieve wall is used for separation of the moulding sand from the castings. The side surface of such a container can be formed by a coaxial combination of cylindrical and/or conical drums of diameters increasing in steps toward the outlet opening of the container and thus forming annular slots. Air flow is initiated by a pressure difference inside and outside the container this being obtained by exhausting the dusted air and water vapor through casing of outlet opening and covering outlet opening.

14 Claims, 10 Drawing Figures

EQUIPMENT FOR COOLING AND SEPARATION OF CASTINGS AND MOULDING SAND

BACKGROUND OF THE INVENTION

The present invention relates to a drum for continuous cooling and separation of metallic castings from moulding sand forming previous casting moulds.

In known drum equipment designs used for this purpose, the general principle of heat exchange between the castings and moulding sand during their relative displacement in the drum is gainfully employed followed by evaporation of process water contained in the mass together with the water additionally introduced into the mass as well as withdrawal of steam outside the equipment. Cooling effected during such a process is accompanied by knocking out cores, crushing of the moulding sand, cleaning of castings, homogenization and dedusting of moulding sand. The existing structural designs are based on the use of a container revolving around a longitudinal horizontal or near horizontal axis. One of the bases is an inlet opening for introducing the moulding sand together with the castings. The outlet opening for castings is located on the other side of this container. A sieve wall for separation of the moulding sand is in the neighborhood of the outlet opening of the container over a determined segment there. Against the background of such a solution, several inventions have been devised aimed primarily at intensification of cooling of castings and moulding sand.

In the equipment presented in the French Patent No. 2,167,308, the cooling process is prolonged and also embraces the stage after separation of the moulding sand from the castings. The revolving container with the inlet and outlet openings exposed on both sides is enclosed with a coaxially connected jacket. The space between this jacket and the container is closed on the side of the inlet opening by means of a guard connected with an exhaust system. The side surface of the container shielded with the jacket is provided with a sieve wall. The end piece of the jacket is also made in the form of a sieve and is surrounded by a container for moulding sand. During the rotary motion of the container, the moulding sand is separated by the sieve wall, falls on the inner surface of the jacket, moves along this surface and after being sieved falls into the container. Air flow through the equipment initiated by suction action of the guard produces an inflow from both sides of the container that is through the inlet and outlet openings and then subsequently, through the meshes of the sieve wall of the container to a space encased in the jacket. Pouring of sand over a considerable length of the container shortens the time and reduces the intensity of heat abstraction from the castings to the moulding sand and, at the same time, limits the possibilities of introducing additional water. Main air streams flowing into the container do not pass directly above the pouring moulding sand and castings, but in the upper portions of the section of container, this being due to the fact that they are directed toward the exposed meshes of the sieve wall. This phenomenon reduces the intensity of evaporation of moisture and the efficiency of direct heat exchange. In order to obtain the final temperatures of the castings and moulding sand required, the equipment must have considerable dimensions.

SUMMARY OF THE INVENTION

The present invention is aimed at elimination of the above mentioned drawbacks by devising such a design of the equipment wherein an increased intensity of the entire cooling process is ensured by blowing the entire volume of the moulding sand and castings moving in the container with an air stream prior to separation of the moulding sand from the castings.

The equipment according to the invention is provided with several slots enabling an air flow into the container, the slots being located on the side surface of the container in one or several places in front of the sieve wall. The side surface of the container provided with these slots may be produced by a coaxial combination of cylindrical and/or conical drums of diameters increasing step wise toward the outlet opening. The drums are connected with one another in such a way that the subsequent drum embraces the preceding one over a determined segment, thus forming an annular slot rendering possible a longitudinal air flow between the drums. Air inflow into the container is initiated by a pressure difference outside and inside the containter. An inlet opening of the container is surrounded by a casing connected with the exhaust system via a suction duct. An outlet opening is shielded with a stationary cover in the bottom part of which there is an opening for removal of the castings closed with a tilting flap.

The aforementioned permits an intensified evaporation of moisture contained in the moulding sand by generation of a vacuum within the range of highest temperature and by increasing the drying potential of air preheated in a space between the drums. The equipment according to the invention also exerts an influence upon the air flow initiated by suction acting toward the shield of the inlet opening. Due to an arrangement of oblique partitions in the space between the drum walls which are directed in such a way, that during the rotary motion, air is forced into the container and the air streams receive a preliminarily swirling motion favoring the heat exchange.

An alternate embodiment of the present invention relates to design where the space between the drum walls is divided by suitable partition walls into several longitudinal ducts, the air inlet opening being separated from this space by a suitable air guide. This air guide enables an air flow into the container through the opening within the range of a central angle, corresponding only to an angle of pouring of moulding sand in the drum. In this way, the stream flowing into the container must penetrate through a layer of pouring moulding sand thus ensuring direct cooling of this sand. Moreover, the said partitions form elements increasing the area of heat exchange with the flowing air. Blowing of the layer of sand pouring between the drums can be intensified by providing the equipment with a fan forcing air through the respective pipe into the space between the drums.

An increased flow of cooling air through the medium pouring into the container is achieved by means of still another shaping of the side surface of the container characteristic, in that in front of the sieve wall of the container there is a slotted air grid surrounded outside by a wind box within an area determined by the central angle of pouring of the sand during revolution of container. Air is forced through the duct to the wind box and flows next through the grid slots and the material lying on it. This solution has been improved by the introduction of a guard connected with the wind box and embracing the grid over the remaining part of circumference. The air grid is provided over its external circumference with longitudinal ribs, the apices of which determined (when revolving the shape and dimensions of the guard providing the labyrinth) sealing of the wind box. The air grid can be made of perforated sheet metal with point or linear openings directed along the container axis and produced preferably by bending away the cut wall. The recommended construction of the air grid consists of longitudinal component parts arranged relative to one another in such a way that they overlap one another over a definite segment and the linear slots thus formed guide the flowing air stream in a direction opposite to the direction of rotation of the container. This protects to considerable extent the falling of sand into the air box at the points of lower pressure.

An additional embodiment of the invention is directed to a deflection of longtidudinal ribs toward the direction of rotation of the container in such a way that they are no longer vertical and a duct is perpendicularly introduced to the air box from the direction opposite to that of rotation of the container. The deflected ribs form special pockets which additionally utilize the dynamic character of the air stream flowing into the wind box. A small amount of sand pouring through the grid is removed outside either by an exhaust slot located in the bottom of the wind box or by a special exhaust system of intermittent or continuous operation. A worm conveyor is best suited to this aim, the outlet of this conveyor is located at the point of removal of the sand being sieved from the container, however, a tilting cover loaded with a lever on a definite arm can also be used. Air flow through the sand is considerably facilitated due to reduced compactness of the sand pouring at the time of rotation of the container.

The present invention is able to abstract considerable amounts of heat. By creating conditions enabling an intensive evaporation of moisture, it is possible to introduce increased amounts of water into the container. As a result, the required final temperatures are obtained in a vessel of smaller length. In case of overall dimensions of installations suited to the output of the modern moulding lines, this provides an essential reduction in the production area of casting house.

The invention will be best understood with respect to the accompanying specification, claims and drawings.

IN THE DRAWINGS

DESCRIPTION OF THE INVENTION

Figure 1:
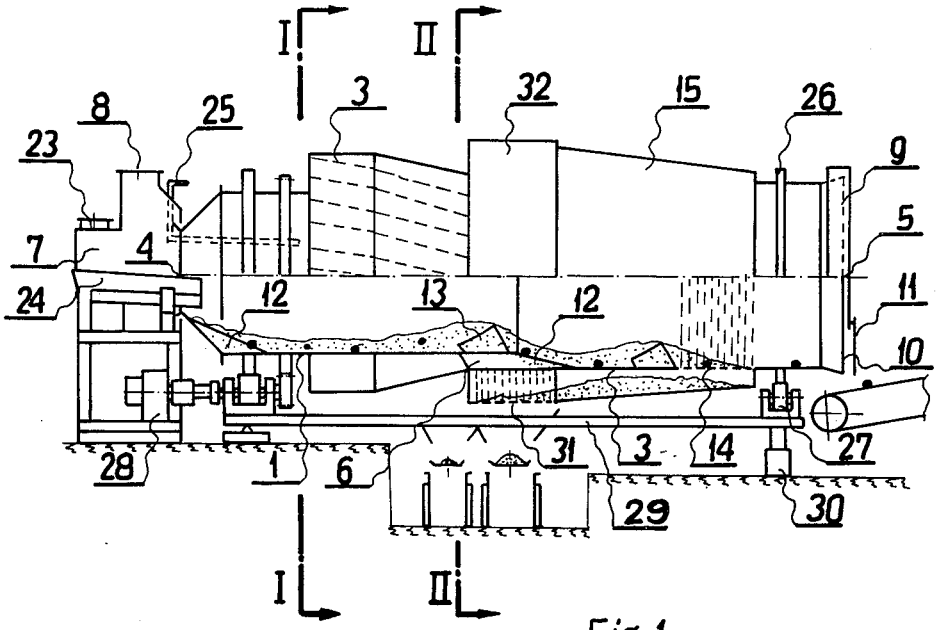
FIG. 1 shows the side view with an axial half-section of a first embodiment.

The equipment shown in FIG. 1 has a cylindrical container established rotationally relative to the longitudinal and horizontal axis in bearing assemblies: race 26 fixed onto the container and supporting rollers 27 mounted on frame 29, the inclination angle of the said frame being adjustable in rest 30. Rotary motion is imparted by the drive unit 28 consisting of an electric motor, transmission gear with infinitely variable transmission ratio and a transmission gear with a constant transmission ratio. The container is produced by combining an initial cylindrical drum 1 of smaller diameter with a final drum 3 of greater diameter in such a way that the initial drum 1 is embraced by the final drum over a determined segment. Such a connection enables a free flow of air in the longitudinal direction through the annular slot formed between the drums. The side surface of the final drum 3 has a conical shape over a segment embracing the initial drum 1, thus forming a suction funnel with the smallest cross section area at the end of the initial drum 1. This is aimed at increasing the velocity of air stream. The annular slot 6 is divided into several ducts 17 by partitions 18 fixed obliquely between the walls of the initial drum 1 and final drum 3 and in a direction which helps to force the air into the container.

The initial drum 1 has in its front part an inlet opening 4 through which the moulding sand together with the castings is introduced into the container. Inlet opening 4 is enclosed with casing 7 inside of which vibrating conveyor 24 is disposed. In the top wall of casing 7 there are: filler opening 23 for loading the castings and moulding sand and a suction duct 8 connected to an exhaust system. On the other side of the container, the outlet opening 5 of final drum 3 is closed with an immovable cover 9 provided in its bottom part with an opening 10 for removal of castings. This opening is shielded by flap 11 deflecting under the weight of the casting leaving the equipment. Vertical adjustment of flap 11 renders possible variation of the amount of air flowing into the container from this direction. The final drum 3 is provided with a sieve wall 14 located in the neighborhood of the outlet opening 5, the said wall being aimed at the separation of the moulding sand. The cylinder of the final drum 3 is embraced by a coaxial jacket 15 in the shape of a truncated cone. The space between the drum 3 and the jacket 15 is closed on one side behind the sieve wall 14 over a smaller diameter of the cone. The side surface of the jacket has a sieve part 31 at its base extending over a determined length for additional sieving of sand. The sieve part 31 includes the guard 32 within the angle of moulding sand pouring in the jacket 15, the said guard being opened both over the length of the sieve part and on the side of the front part.

At the near end of the drum 1 and in drum 3 where the pouring of sand from drum 1 takes place the initial blades 12 are mounted and made of sheet metal shaped in such a way that when revolving they move the moulding sand in conformity with the direction of operation of the equipment. At the end of the drum 1 and in drum 3 before the sieve wall 14 there are the end blades 13 slowing down the speed of the flowing medium contained in the drum during the rotary motion of the last. The distributing ribs 16 are mounted between the blades 12 and 13 and on the outer surface of the jacket 15. Tube 25 introduced into the drum 1 through the wall of the casing 7 is provided with nozzles spraying the pouring moulding sand with water.

Figure 2:
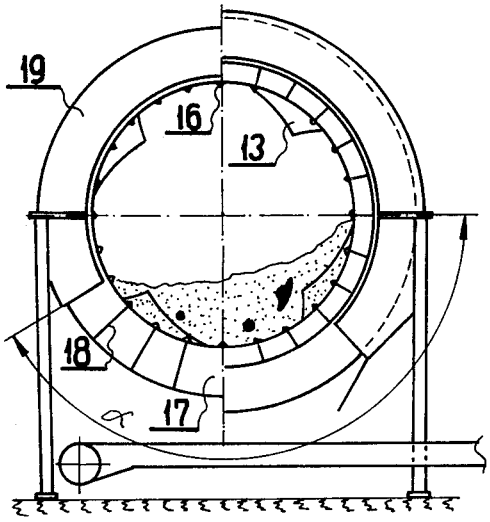
FIG. 2 is a cross section of the equipment along line II—II shown in FIG. 1 and a cross section along line I—I of the equipment shown in FIG. 1 provided additionally with an air guide.

Still another embodiment of the invention is equipment of the above described design but additionally provided with an air guide 19 forming an air inlet to the space between the drums. This has been shown in FIG. 2 in a half-cross section along line I—I. An air stream sucked into the container in this embodiment is forced to penetrate through the moulding sand pouring from the initial drum 1 into the final drum 3. This has been rendered possible due to a stationary air guide 19 opening for the air flow from outside only the ducts 17 being actually within the range of the central angle $\alpha$, corresponding to the angle of the moulding sand pouring during the rotary motion of the container.

Figure 3:
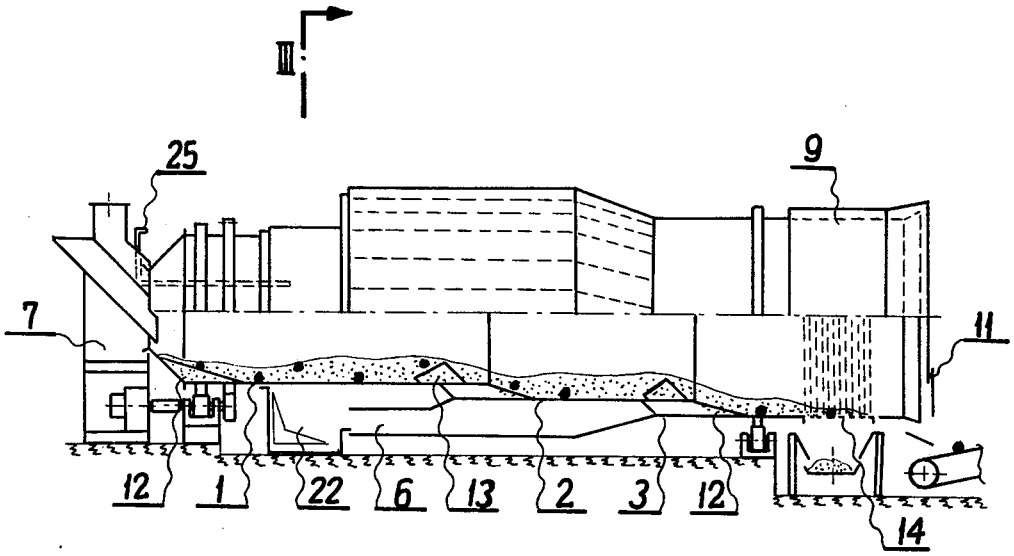
FIG. 3 shows the side view with an axial half-section of a second embodiment of the equipment.
Figure 4:
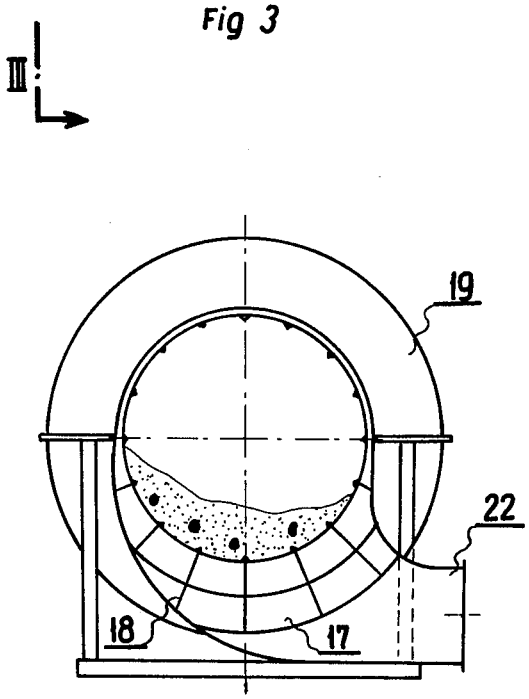
FIG. 4 shows the cross section of the equipment along line III—III shown in FIG. 3.

FIG. 3 shows a possibility of a further extension of the invention ensuring an intensified direct cooling in the space between the drums. Unlike the previously described embodiments, this equipment has three drums 1, 2 and 3 forming together a container and an elongated final drum 3 and both annular slots 6 lying in one plane. Opening of the air-guide 19 mounted in this plane is embraced by a pressure tube 22 connected with a fan. Such a design ensures effective cooling particularly in case of installations of great output provided there is an adequate vacuum in the container which may be obtained by the selection of an appropriate pressure and suction fan.

Figure 5:
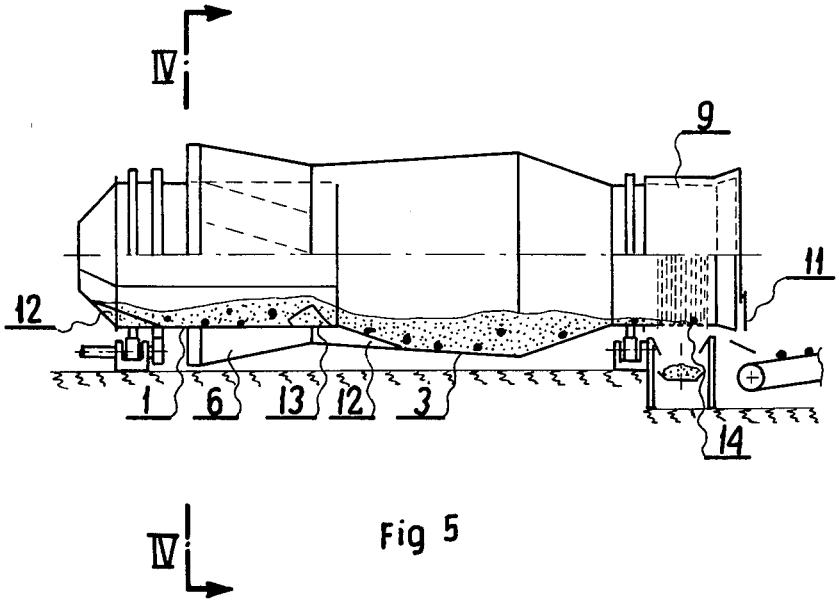
FIG. 5 shows the side view of a third embodiment.
Figure 6:
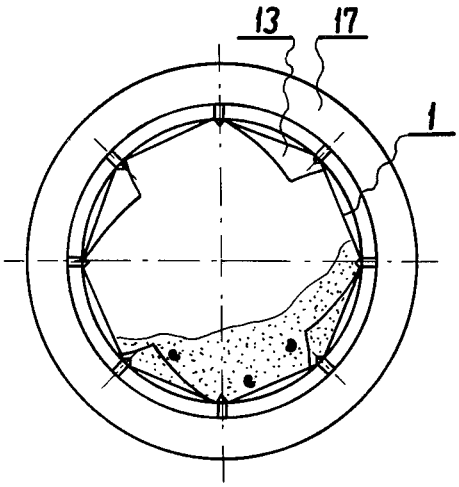
FIG. 6 is a cross section along line IV—IV of the equipment shown in FIG. 5.

A third embodiment of the invention shown in FIG. 5 represents a design wherein the container is formed by a combination of cylindrical initial drum 1 of cross section in the shape of a regular polygon with a conical final drum 3. The shape of the side surface of the drum 3 is determined by two truncated cones folded with major bases and connected with minor bases: funnel-shaped surface forming an annular slot around the drum 1 and, on the opposite end, a cylindrical surface with a sieve wall 14. Drum 3 has no end blades 13, since the flow of the moulding sand together with the castings is slowed down by the rising side surface. The remaining elements and operating units which are not shown in the figure are identical as in the previously described embodiments.

Figure 7:
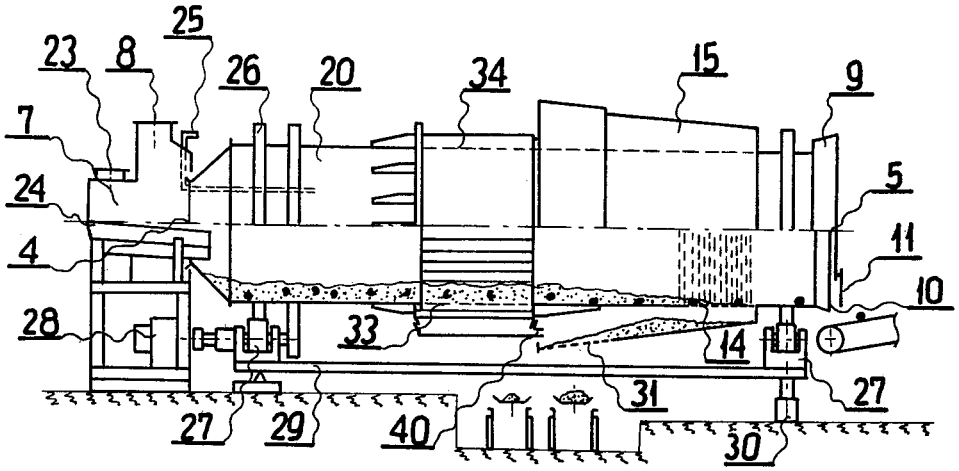
FIG. 7 is a fourth embodiment of the equipment provided with an air grid shown in side view with axial half-section.
Figure 9:
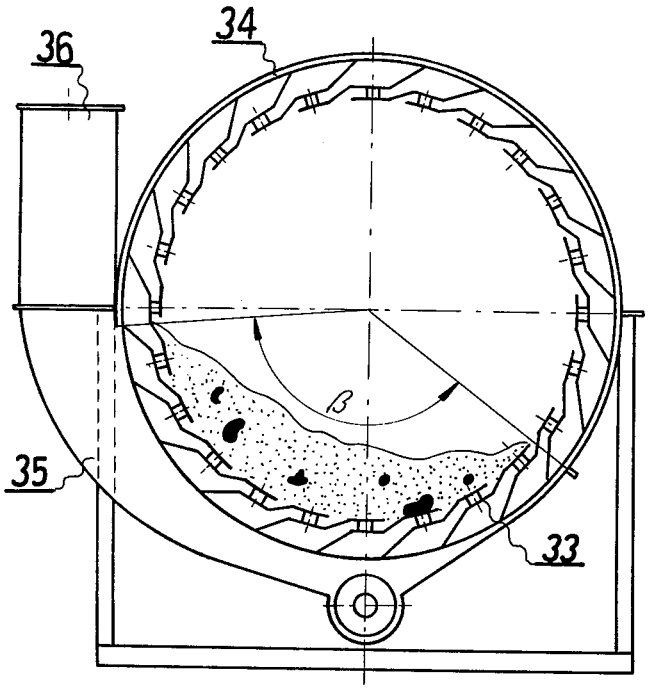
FIG. 9 is another view of a cross section through the air grid.
Figure 10:
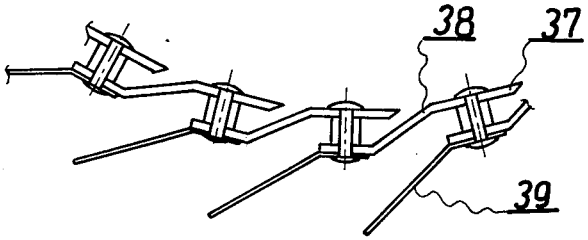
FIG. 10 is a detail of the design of the grid.

The fourth embodiment of the invention is shown in FIG. 7. The structural details of this embodiment being present in FIGS. 9 and 10. It has a cylindrical one-drum container 20 supported and driven in identical way as in the equipment previously shown in FIG. 1. The side surface of this container in front of the sieve wall 14 over a determined length of the container 20 is formed by a slotted air grid 23. The surface of this air-grid 33 is protected from outside by a guard 34. The guard is connected with a wind box 35 over a part of circumference being determined by the central angle $\beta$ corresponding to an angle of moulding sand pouring. The inside of the box 35 is supplied through duct 36 from an air pressure fan. The air-grid 33 is made of longitudinal elements 37 connected with one another in such a way to overlap one another over a determined segment and spacing, thus forming annular slots 38. The suitable arrangement of elements 37 directs the flowing air stream opposite to the direction of rotation of the container 20 thus minimizing the air grid area where the pouring of sand can take place. On the outer face of the air grid 33 longitudinal ribs 39 are mounted, these being structural members acting additionally on the air flow. The dynamic character of the air stream flowing into the box 35 is additionally augmented by an appropriate deflection of the ribs 39 from the radial location relative to the direction of rotation of the container 20 and an appropriate arrangement of duct 36, this being perpendicular and approximately tangential to the container. Apices of longitudinal ribs 39 form together with the guard 34 a movable sealing of labyrinth type protecting against the undesirable escapes of air through air grid 33 outside the range of the central angle $\beta$. An exhaust slot 40 is in the side wall of the wind box 35 (looking toward the inside of the jacket 15) for removing the sand poured through the grid 33 in a stream of outflowing air. The cooling process is intensified by generation of vacuum in the container 20 improving the evaporation of moisture contained in the sand or additionally introduced. To this aim, the front openings of the container 20 have been exposed and the capacity of the exhaust system is greater from the blow of the pressure fan supplying air through grid 33.

Figure 8:
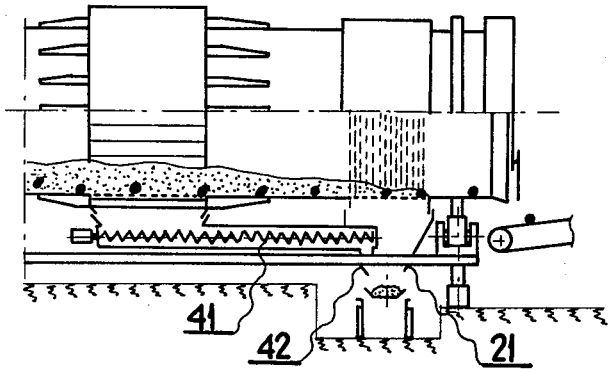
FIG. 8 is a fragment of another embodiment of the equipment provided with a worm conveyor.

FIG. 8 of the drawing shows in half-section a fragment of another equipment wherein the removal of sand from the wind box 35 has been solved in a different way than in the previously described embodiments and the container 20 is not embraced by jacket 15. The bottom of the wind box 35 is closed by a worm conveyor 41 directed along container 20 in such a way that its discharge channel 42 be introduced into the discharge 21 under the sieve wall 14.

Many modifications and variations of the present invention are possible in light of the above teachings. It is, therefore, to be understood that within the scope of the appended claims, the invention may be practiced otherwise than as particularly described.

We claim:

1. Apparatus for cooling and separating castings from moulding sand, comprising in combination: a rotary container of longitudinal axis substantially horizontal, said container having on one side thereof an inlet opening for introducing the moulding sand together with the castings said inlet opening is enclosed with a casing connected by means of a suction duct having an exhaust system associated therewith, and, on another side, an outlet opening to remove castings; a sieve wall located between the said openings to remove moulding sand; said apparatus being further defined by at least one slot (6, 38) over the circumference of the side surface of the container (1, 2, 3, 20) wherein said slot being located before the sieve wall (14) on the side of the inlet opening (4) for ensuring inflow of air into the container and said outlet opening (5) having a stationary cover (9) provided at its bottom part with an opening (10) for removal of castings.

2. An apparatus as claimed in claim 1, wherein: said container comprises coaxial drums (1, 2, 3) of diameters increasing stepwise toward the outlet opening (5) connected with one another in such a way that the subsequent drum is embraced over certain segment by the previous one to form said slot.

3. An apparatus as claimed in claim 2, wherein the last drum (3) has a coaxial jacket (15) connected on one side of the drum behind the sieve wall (14).

4. An apparatus as claimed in claim 3, wherein: the annular slots (6) are divided into several ducts (17) by partitions located obliquely between the drum walls in such orientation that air is forced into the drum during the revolution of the drum.

5. An apparatus as claimed in claim 3, wherein: annular slots (6) are divided into several longitudinal ducts (17) by means of partitions (18) mounted between the drum walls.

6. An apparatus as claimed in claim 5, wherein: an air inlet to the annular slot (6) is enclosed with pressure tube (22) connected to a fan.

7. An apparatus as claimed in claims 5 or 6, wherein: the air inlet to the annular slots (6) is guarded by an air-guide (19) provided with a hole within the range of the central angle ($\beta$) corresponding to an angle of pouring of the sand mass in the drum.

8. An apparatus as claimed in claim 1 wherein: said slots (38) are formed by an arrangement of the individual component parts of an air grid (33) formed as a part of the side surface of the container (20) in front of the sieve wall (14), said air grid being enclosed on the outside by a wind box (35) over an area corresponding to central angle ($\beta$) of sand stream enabling air to be forced into thus wind box through ducts (36).

9. An apparatus as claimed in claim 8, wherein: a guard (34) is connected to the wind box (35), said guard embracing the air grid (33) over the remaining part of its circumference.

10. An apparatus as claimed in claim 9, wherein: longitudinal ribs (39) are formed over the outer surface of the air grid (33) whereas the apices of these ribs engage the surface of the guard (34) forming a labyrinth sealing.

11. An apparatus as claimed in claim 10 wherein: the air grid (33) is made of longitudinal elements (37) arranged in relation to one another to overlap over a determined length for a definite segment and the line slots thus formed (38) direct the flowing air stream in the direction opposite to that of the rotation of the container (20).

12. An apparatus as claimed in claim 10, wherein: longitudinal ribs (39) are deflected toward the direction of rotation of the container (20) and the air pressure duct (36) is introduced into the air box (35) perpendicularly to the container (20) from a direction opposite to its rotation.

13. An apparatus as claimed in claim 9 wherein: an exhaust slot (40) is provided for removal of sand seived through the air grid (33) located in the bottom of the air box (35).

14. An apparatus as claimed in claim 9, wherein: the bottom of the wind box (35) is closed with a worm conveyor (41) for removal of sand being poured through the air grid (33).

* * * * *